US007338361B1

(12) United States Patent
Luciano, Jr.

(10) Patent No.: US 7,338,361 B1
(45) Date of Patent: Mar. 4, 2008

(54) INTERACTIVE "21" GAMING SYSTEM AND METHOD

(75) Inventor: Robert A. Luciano, Jr., Reno, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 691 days.

(21) Appl. No.: 10/821,785

(22) Filed: Apr. 8, 2004

(51) Int. Cl.
*A63F 9/24* (2006.01)

(52) U.S. Cl. ..... 463/12; 463/42

(58) Field of Classification Search ..... 463/11, 463/12, 13, 40, 42
See application file for complete search history.

(56) References Cited

U.S. PATENT DOCUMENTS 4,093,215 A * 6/1978 Ballard ..... 463/11
4,614,342 A * 9/1986 Takashima ..... 463/11
4,760,527 A * 7/1988 Sidley ..... 463/13
5,288,077 A * 2/1994 Jones ..... 273/292

* cited by examiner

*Primary Examiner*—Robert E Pezzuto
(74) *Attorney, Agent, or Firm*—Michael A. Kerr; Virtual Legal, LLC

(57) ABSTRACT

A system and method for playing an interactive twenty-one game with a deck of playing cards that comprises a plurality of playing squares. Each game session comprises a plurality of game events in which one or more playing cards are drawn from a deck and transferred to one of the plurality of playing squares. Each of the playing cards has a specified predetermined value. Each game event comprises drawing one or more playing cards from the deck and transferring each of the playing cards to one of the playing squares. The player is awarded one or more prizes according to a dynamic paytable. For the chargeable action embodiment, the player is charged at least one credit for drawing the playing cards from the deck and transferring the playing cards to one of the playing squares.

37 Claims, 11 Drawing Sheets

260

| NEXT | Mixed Suit | Same Color | Same Suit |
|---|---|---|---|
| Blackjack | 2 | 4 | 6 |
| 21 | 1 | 2 | 3 |

INTERACTIVE "21" GAMING SYSTEM AND METHOD

CROSS REFERENCE

This patent application is related to patent application Ser. No. 10/214,862 filed on Aug. 7, 2002 which is related to patent application Ser. No. 10/041,940 filed on Oct. 17, 2001 (now abandoned) which is related to patent application Ser. No. 09/665,742 filed on Sep. 20, 2000 (now U.S. Pat. No. 6,368,214) which is related to patent application Ser. No. 09/267,126 filed on Mar. 10, 1999 (now U.S. Pat. No. 6,129,632) which is related to patent application Ser. No. 08/866,931 filed on May 31, 1997 (now abandoned), all of which are hereby incorporated by reference.

BACKGROUND

1. Field of Invention

The present invention is an interactive card based gaming system and method. More particularly, the invention is an interactive twenty-one game in which a player is awarded a prize for having a winning hand according to a paytable.

2. Background

Traditional Blackjack is a table game in which the table seats a dealer and one to seven players. A betting square is printed on the felt table in front of each player seat. To the left of the dealer is a deck of cards or a shoe. Play begins after the dealer shuffles the cards, the deck is "cut" by a player using the marker card, and the dealer "burns" a card. Before any cards are dealt, each of the players may make a wager by placing the desired chips (value and number) near the betting square.

Once all the bets are placed, two cards are dealt from left to right one at a time. The dealer receives one card down and one card up. The Kings, Queens and Jacks count as 10 points, the Aces count as either 11 or 1 point, and the remaining cards have a point value that corresponds to their face value.

The rules the dealer must play by are very simple. If the dealer's hand is 16 or less, the dealer must take a card. If the dealer's hand is 17 or more, the dealer must stand. The dealer's strategy for hitting or standing is fixed and the dealer's strategy is not affected by the actions of the players.

The player has many options as related to hitting or standing. If a player hits a Blackjack, the payoff is 150% more than the original bet. Additionally, the player has the option of "doubling down" on a 2-card hand that usually totals 9, 10, or 11. In addition to "doubling down" the player is permitted to split a hand and to obtain insurance. Note, that the rules for Blackjack differ slightly from casino to casino.

Blackjack may also be played on an electronic device. The electronic device mimics the table game by providing one or more betting squares and simulating the shuffling and dealing of the cards. Additionally, during a game of "video" Blackjack the player is provided with an opportunity to make an initial game wager, and hit or stand with cards dealt from the dealer.

In spite of the random nature of the card dealing process, the game of Blackjack is viewed by many players as a game of skill. For purposes of this patent, "player skill" includes three components: minimal skill, dexterity skill, and knowledge skill. Generally, all games include these components, however, the degree of skill varies for each game. Minimal skill requires a minimal understanding of the rules of the game and minimal dexterity needed to apply the rules of the game. To play a game according to the game rules, the player must possess minimal skill.

By way of example and not of limitation, a lottery game is a game that in principle only requires minimal skill. The minimal skill is the selection of numbers from a card having a plurality of numbers within. The correct amount of numbers must be identified before the lottery drawing. The game outcome is theoretically random so little or no dexterity skill or knowledge skill is used. Other games that theoretically rely on random events include traditional keno and stand-alone slot machines.

Dexterity skill is based on the player's reflexes or coordination. Most games require a degree of dexterity to establish game play. Certain games such as arcade video games or pinball machines are primarily dexterity based skill games. For example, in the well- known "Pong" video game, the player removes bricks from a wall by causing a ball to "hit" the brick with a player controlled paddle. Dexterity skill is needed to ensure that the ball strikes the paddle so that the player may continue playing the game. The objective during game play is to generate as many points as possible, and this objective is generally achieved by playing the game as long as possible.

Knowledge skill is based on the player's experience and analytical abilities. Most games require a degree of knowledge skill during game play. For example, the Pong game described above requires a certain amount of knowledge skill in anticipating how the ball will bounce off the brick wall. However, this level of knowledge is minimal when compared to the level of dexterity skill.

An illustrative example of a casino-type game that uses knowledge skill is a standard video poker game of Jack or Better. In this video poker game a player is provided with a choice of which cards to hold and which cards to discard in exchange for newer cards. The optimum choice made by the player is dependent on the paytable for the video poker game. For illustrative purposes, with a paytable that pays a Royal Flush 800, a Straight Flush 50, Four of a Kind 25, a Full House 9, a Flush 6, a Straight 4, Three of a Kind 3, Two Pair 2 and a Pair of Jacks or Better 1, the player has a theoretical optimum return of 99.5%. Thus, if a player starts with a $20 bill, and wagers $1 at a rate of six games per minute, this loss rate is $1.80 per hour and on average the player could play for 11 hours before consuming all the playing funds. In the illustrative example of the standard video poker machine, the knowledge skill used by the player is dependent on the amount wagered, the cards initially dealt to the player, the cards discarded by the player, the new cards provided to the player and the paytable for compensating the player. During the game session, the player attempts to optimize his/her award according to the paytable. Since the optimal player outcome is dependent on the paytable, a "knowledgeable" player's decision will be highly dependent on the paytable. The paytable provided in the illustrative standard video poker machine is a static paytable. A static paytable does not change during game play and provides a fixed award for each award event.

It shall be appreciated by player experienced in Blackjack that the traditional Blackjack game and the video Blackjack version requires a heightened level of knowledge based skill similar to the video poker game described above. The player has the opportunity to apply a variety of different strategies to maximize winnings and minimize losses.

SUMMARY

A method for playing an interactive twenty-one game with a deck of playing cards that comprises a plurality of playing squares. Each game session comprises a plurality of game events in which one or more playing cards are drawn from a deck and transferred to one of the plurality of playing squares. Each of the playing cards has a value in which Kings, Queens and Jacks count as 10 points, Aces count as either 1 or 11 points, and all other cards have a point value that corresponds to their face value. Each game event comprises drawing one or more playing cards from the deck and transferring each of the playing cards to one of the playing squares. The player is awarded one or more prizes according to a dynamic paytable. For the chargeable action embodiment, the player is charged at least one credit for drawing the playing cards from the deck and transferring the playing cards to one of the playing squares. For the average bet embodiment, the player is only charged at the beginning of the game session.

An interactive twenty-one gaming system comprises a player interface, a credit meter, a processor and a memory. The player interface is configured to display at least one deck of playing cards and a plurality of playing squares. The playing squares are configured to receive one or more cards and from the deck of playing cards. The processor is in operative communication with the player interface and the processor is configured to determine when to award the player a prize. The memory is communicatively coupled to the processor and is configured to store a dynamic paytable that identifies prizes awarded for having the player obtain a winning twenty- one card combination. For the chargeable action embodiment, the credit meter monitors available credits that are wagered for each chargeable action. For the average bet embodiment, the credit meter monitors available credits that are wagered at the beginning of the game session.

BRIEF DESCRIPTION OF THE DRAWINGS

Embodiments of the present invention are shown in the accompanying drawings.

DESCRIPTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the claims.

Illustrative Gaming System

Figure 1:
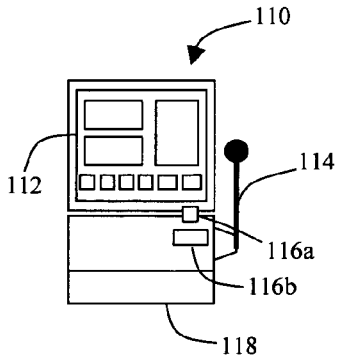
FIG. 1 is an illustrative stand-alone system for the interactive twenty-one game.

Referring to FIG. 1 there is shown an illustrative stand-alone device 110 configured to provide an interactive twenty-one gaming system and method. In the illustrative embodiment, the stand-alone device 110 is an electronic device that has a touch screen video display 112 which acts as a player interface. The illustrative video display player interface 112 embodiment is described in further detail below.

The electronic device 1 10 is a dedicated gaming device, a computer having interactive twenty-one gaming software, a personal digital assistant, or any other such device or combination of devices that displays the interactive twenty-one game of the present invention. As shown, the illustrative stand alone device 110 also includes a handle 114 that acts as a player interface component. The function of handle 1 14 may be similar to the function of a handle in a conventional slot machine.

Additionally, the illustrative stand alone device 110 includes a monetary input component that is configured to receive money or transferable credits, respectively. The illustrative monetary input component 116*a* is a device adapted to receive coins. The illustrative monetary input component 116*b* is a device adapted to receive transferable credits. The transferable credits may be provided by a coupon based system. Other monetary input components may be configured to receive bills, credit cards, debits cards, smart cards, electronic currency and other such means for transferring money or credits.

A coin hopper 118 is used to distribute an award to the player. It shall be appreciated by those skilled in the art that any other components for distributing awards may also be used instead of the coin hopper 118. These other components for distributing awards include a paper coupon, a smart card, a mag stripe card, or any other such means that can record the transfer of money or credits to the player.

Figure 2:
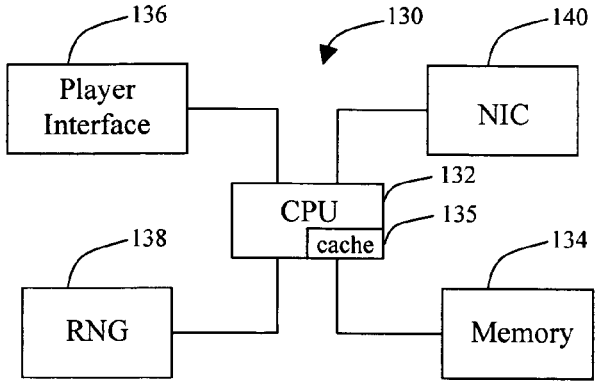
FIG. 2 is an illustrative block diagram of the system for the interactive twenty-one game of FIG. 1.

Referring to FIG. 2 there is shown an illustrative block diagram of the system for the stand alone device 110. The system 130 for the stand alone 110 device includes a logic component that is operatively coupled to internal components that manage the various gaming systems and operations for the interactive twenty-one game. In one embodiment, the electronic device may be a computer in which the logic component is a central processing unit (CPU) 132 and a memory 134 that stores the gaming operations such as the paytable and other processes of the interactive twenty-one game. A fast memory cache 135 may also be employed by the CPU 132 to more efficiently access data or software stored in the memory 134. It shall be appreciated by those skilled in the art that the memory cache is a memory that is resident on the CPU 132. Additionally, it shall be appreciated by those skilled in the art that logic component does not have to be a CPU and may include a plurality of logic gates and switches that are either programmed, e.g. a field programmable gate array, or may be an application specific integrated circuit (ASIC).

Additionally, in the illustrative embodiment a player interface 136 is operatively coupled to the CPU 132. As previously described the player interface 136 may include a touch screen video display 112 and a handle 114. Alternatively, the player interface 136 may also include a video display (not shown) having a plurality of switches (not shown) that permit the player to interact with the stand alone device 110. Another alternative player interface 136 is a computer monitor (not shown) having a keyboard or mouse (not shown). The player interface includes a monetary input component as described above or may be configured to store credit or debit card information. Thus, the player interface 136 includes any interface that permits the player to interact with the stand alone system and input desired gaming parameters according to the interactive twenty-one playing rules.

Thus, the processor 132 is in operative communication with the memory 134 and the player interface 136. The processor 132 processes instructions that awards the player a prize when the output of the player interface matches an award identified by the paytable.

In an illustrative embodiment, a random number generator 138 is also operatively coupled to the CPU 132. The random number generator 138 is typically a software module used in the selection of the playing cards during a game session. The game session is defined as a period during which at least one deck of playing cards is dealt to the player. The game session is terminated when either there are no more playing cards to be dealt, the player is unable to receive a card in a playing square, the player has no more credits, or the player decides to end the game session. The twenty-one playing cards may also be represented as letters, geometric figures, animated figures or any combination thereof. Alternatively, the picking of a playing cards may be simulated using system and methods that provide the appearance of a random selection.

In another alternative embodiment, the stand alone device 110 may include a network interface card (NIC) 140 that permits the stand alone device 110 to communicate with a plurality of other devices configured to play the interactive twenty-one game. The NIC 140 uses well-known networking protocols to communicate with other networked devices. These well known protocols include Ethernet type protocol, TCP/IP protocols or other such network protocols. Additionally, the stand alone devices maybe networked to provide access to a progressive jackpot. The progressive jackpot is a shared jackpot generated from the network of game devices.

Figure 3:
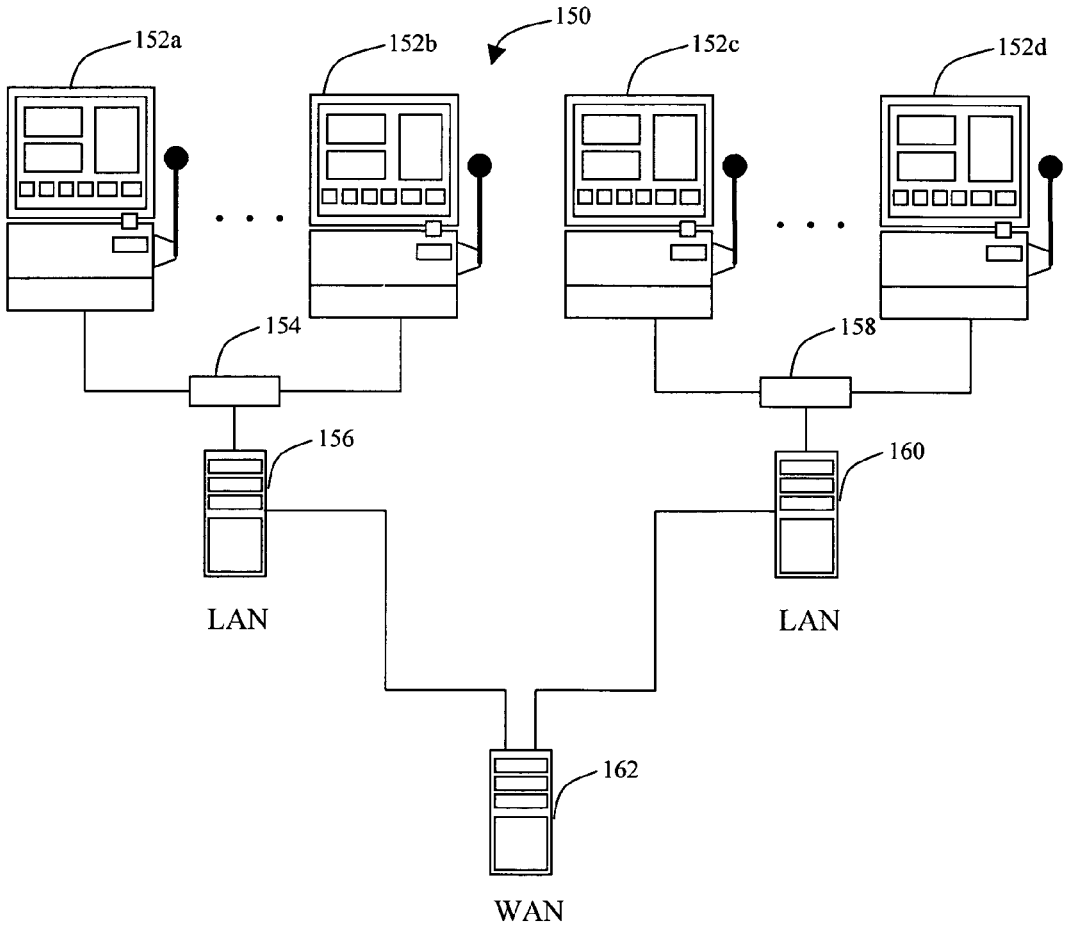
FIG. 3 is an illustrative network system having a plurality of networked systems for the interactive twenty-one game.

Referring to FIG. 3 there is shown an illustrative network system 150 having a plurality of networked devices 152*a* through 152*d*. In the illustrative embodiment, the networked devices 152*a* through 152*d* are similar to the stand alone device 110. In the illustrative network system 150, the networked devices 152*a* through 152*b* are operatively coupled to a node 154 that communicates with a local area network (LAN) server 156. Additionally, the networked devices 152*c* through 152*d* are also operatively coupled to a node 158 that is communication with a LAN server 160. The nodes 154 and 168 may be a hub, router, bridge, gateway or any combination thereof that allows communications between the networked devices. It shall be appreciated by those skilled in the art that each LAN may operate independently of the other.

A wide area network (WAN) is created by linking LANs together. For illustrative purposes only, both LANs communicate with a WAN server 162. For purposes of this disclosure, it can be appreciated that the distinction between a LAN and WAN is primarily geographic in nature. The LAN is geographically limited to a bank of stand alone devices that may be resident on the casino floor. A WAN permits banks of networked devices from different casinos to be networked. A primary purpose for networking the gaming devices is to generate a progressive jackpot. Additional reasons for networking include accounting, diagnostics, player tracking and loyalty programs.

An alternative embodiment to the illustrative network system 150 comprises having the game logic for the interactive twenty-one game resident on a central server. The central server may be either the LAN server 156 or WAN server 162. During game play, the server then communicates game outputs to the appropriate client, i.e. one of the networked devices 152*a* through 152*d*. Yet another embodiment includes having the central server pick the playing cards to display and submit the playing cards to each of the clients on the network.

Interactive "21" Gaming Method

For purposes of this patent, a game session comprises a plurality of game events. The game session is initiated by having the player express a desire to play a game according to the set of game rules. Each game event that occurs during the game session is subject to a set of game rules. The set of game rules also determines how the player is charged for the game session and how the game session is terminated.

The set of game rules determines the level of player skill that may be applied during a game session. The significance of player skill should not be underestimated. For example if the player adopts a skill based strategy that increases the player's return on investment or payback percentage from 90% to 91%, then the player can play 11% more game sessions. If the player adopts an even better skill based strategy that increases the payback percentage to 92%, then the player can play 25% more game sessions. Thus, by adopting a successful skill based strategy, more game sessions can be played with the same "bankroll" or "wad". A bankroll or wad is the total amount of money the player has allocated to playing the game.

Figure 4:
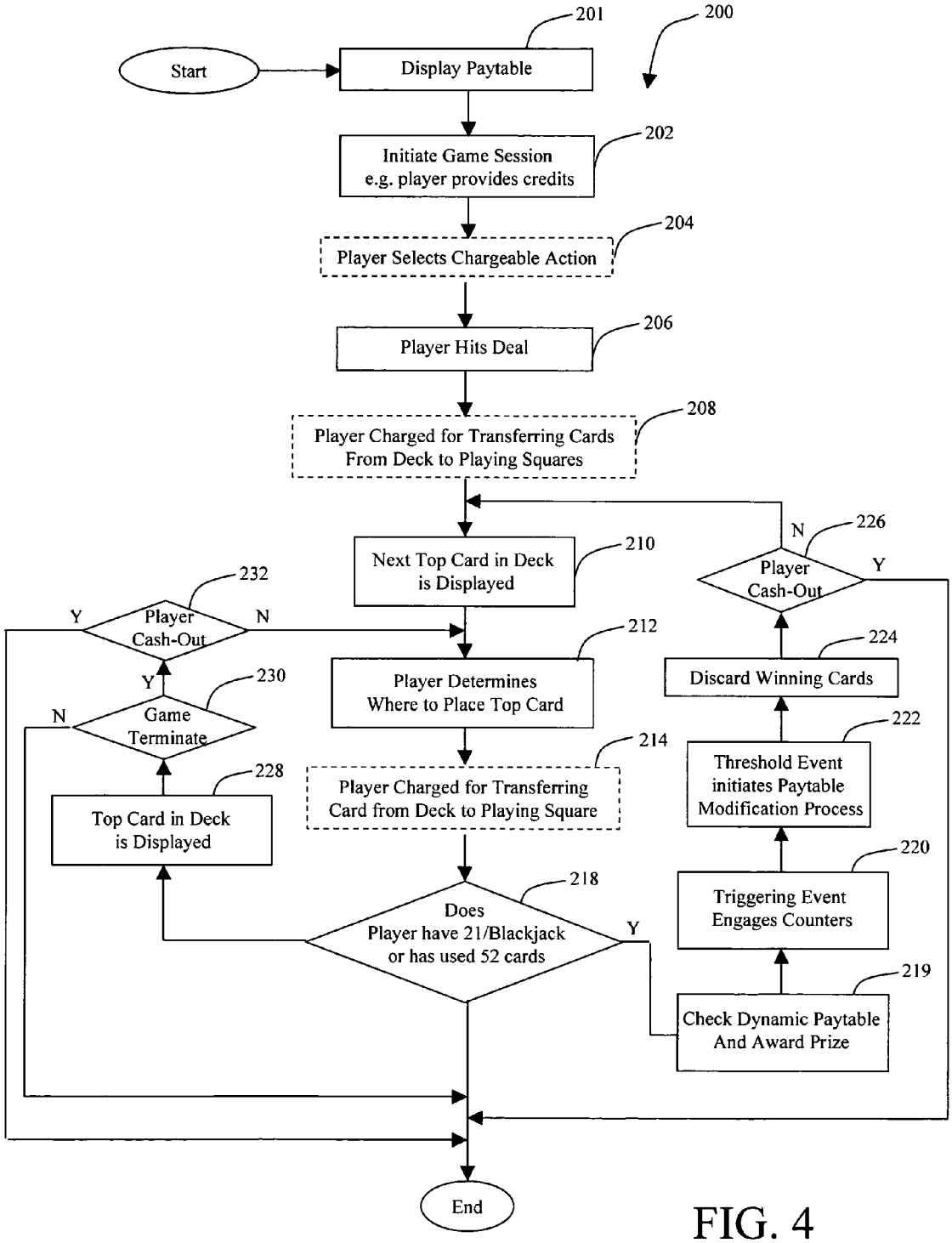
FIG. 4 is a flowchart of a method for playing the interactive twenty-one game.

FIG. 4 is a flowchart for the method of playing the interactive twenty-one game of the present invention. The method 200 for playing the interactive bingo game is initiated at block 201 in which a paytable is displayed. The paytable indicates the possible prizes that may be awarded to the player. In one embodiment, the paytable is a dynamic paytable that is modified during the game session. By way of example and not of limitation a dynamic paytable may be modified as a function of variables that include: the type of twenty-one combination, the number of dealt cards, the number of credits played for each chargeable action, and the remaining number of playing cards. Aspects of the dynamic paytable are described in further detail in FIG. 5 and FIG. 6 below. Alternatively, the paytable may be a static paytable that does not change during the game session.

The method then proceeds to block 202 in which a game session is initiated. When the game session is initiated the display 112 shows an interactive interface such as the illustrative interface in FIG. 7 below. The game session can be initiated with or without the need for game credits. In one illustrative embodiment, the providing of credits includes the inserting of money using coins or currency or the providing of transferable credits derived from coupons, a smart car, a player account, a credit account, or any other such accounts that receive credits or currency. For the "chargeable action" embodiment, the method then proceeds to block 204.

At block 204, the player selects the amount of credits to wager for each "chargeable action". A chargeable action is the amount of credits the player is charged for each card that is transferred from a deck of playing cards to a playing square within the player interface 112. In some instances, a plurality of playing cards may be transferred at one time. In another instance, a single playing card is transferred at one time. By way of example, the player may decide to be charged one credit for each card that is transferred from the deck of playing cards. In the illustrative example, one credit may be worth 10 cents. The chargeable action embodiment then proceeds to block 206.

In an alternative embodiment, hereinafter referred to as the "average bet" embodiment, there is no need for the process performed at block 204. In the average bet embodiment, the credits required for a game session are provided before the game session is initiated. Thus, there is no charge for transferring a card from the deck of playing cards to one the plurality of playing squares. In the average bet embodiment, the gaming method would proceed directly from block 202 to block 206.

At block 206, the game session is initiated when the player hits a "deal" button. The deal button is location on the player interface 112. After hitting the deal button, the cards may be shuffled before the cards are dealt. The shuffling process is intended to provide the appearance that the playing cards within the deck are in a random order. The cards are dealt by transferring cards from the deck to the playing squares. For the average bet embodiment, the player is not charged for the transferring of cards from the deck to one or more of the playing squares. For the chargeable action embodiment, the method then proceeds to process block 208.

For the chargeable action embodiment, at block 208 the player is charged for being dealt playing cards and for transferring each card from the deck to each of the playing squares. In one illustrative embodiment, there are five playing squares configured to receive at least one playing card from the deck of playing cards. As displayed in FIG. 7 below, there is an illustrative five playing squares configured to receive playing cards from the deck. In another illustrative embodiment, there are seven playing squares. In the illustrative chargeable action embodiment, a credit meter is decremented and a bet meter is incremented according to the number of credits wagered. The player is charged for each card dealt according to the number of credits identified in block 204. For the illustrative five-card embodiment, a single card from the deck of playing cards is placed in each of the five playing squares. Each card that is dealt is shown face up so that the player may see the value of the card. The playing cards have a point value that corresponds to well known poker rules as described above. The method then proceeds to block 210.

At block 210 the next top card in the deck of playing cards is displayed on the player interface. The method then proceeds to block 212 where the player determines in which playing square to place the displayed top card. The playing cards have a point value that corresponds to each card. For Kings, Queens, and Jacks the point value is 10 points, for Aces the point value is 1 or 11, and for all the remaining cards the point value corresponds to their face value. In the illustrative embodiment there is a playing square counter associated with the player cards resident in each playing square. The objective for the player is to achieve a total count of "twenty-one" in one of the playing squares. The player evaluates in which of the plurality of playing squares to place the displayed top card.

At block 214, the chargeable action embodiment provides for the player being charged according to the amount of credits identified in block 204. For the chargeable action embodiment, after block 214 the method then proceeds to decision diamond 218. For the average bet embodiment, the process performed at block 214 is not performed and the method proceeds directly from block 212 to decision diamond 218.

At decision diamond 218, it is determined whether a prize is awarded. The type of prize awarded is dependent on the paytable displayed in block 201. As previously mentioned, the player is awarded a prize when the total count in one of the playing squares is twenty-one. If a prize is awarded to the player then the method proceeds to process block 219.

Figures 5, 6:
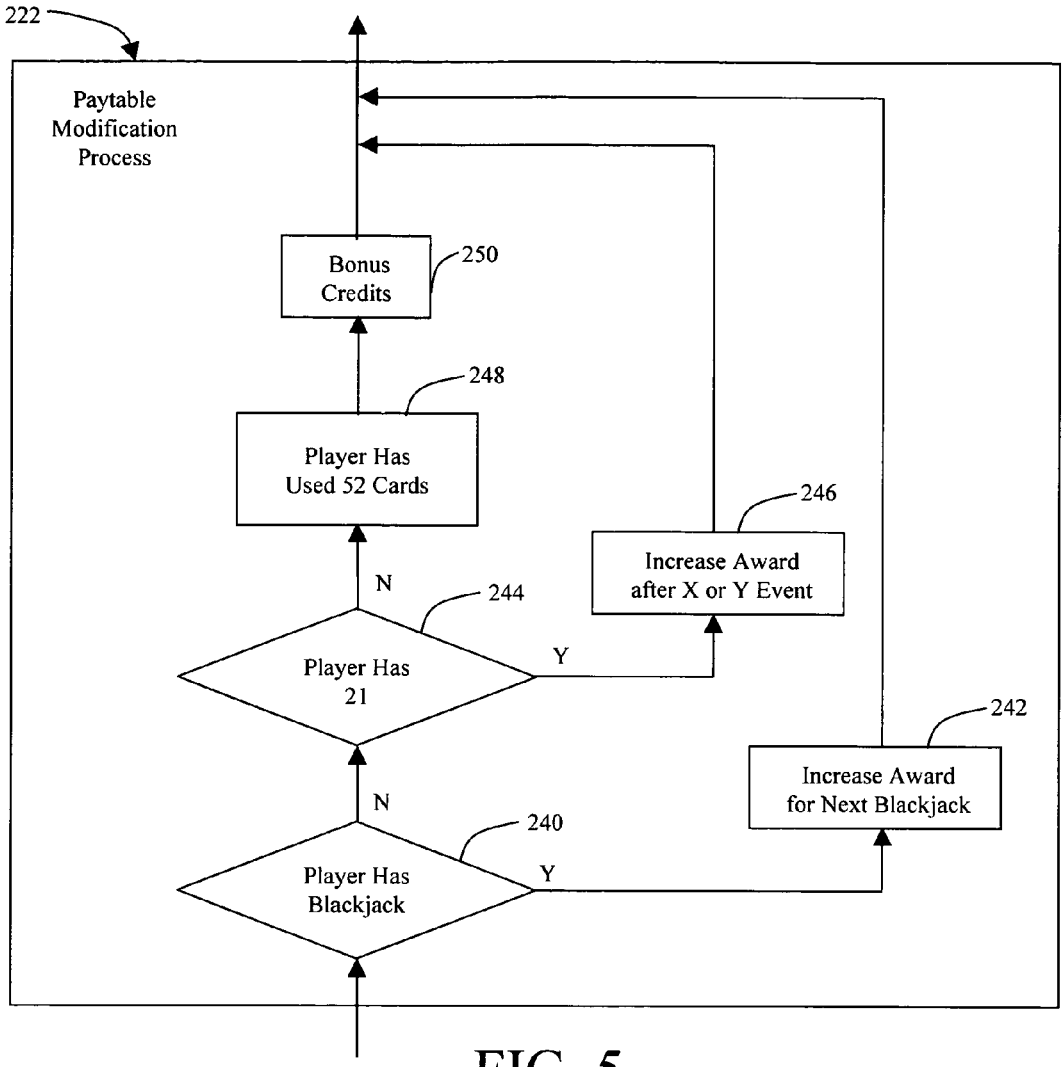
FIG. 5 is a flowchart of the paytable modification process.
FIG. 6 is an illustrative example of a paytable.

At process block 219, the paytable is evaluated to determine the prize that is awarded to the player. The prize awarded is dependent on the playing cards that were used to achieve the winning twenty-one combination. An illustrative example of a paytable is shown in FIG. 6 described further below. As previously mentioned, the paytable may be a dynamic paytable or a static paytable. Recall that the dynamic paytable changes during the game session and the static paytable remains the same during a game session. For the illustrative embodiment a dynamic paytable is employed.

For the dynamic paytable embodiment, the method proceeds to block 220 where a triggering event starts or increments one of a plurality of game history counters. A triggering event occurs each time there is a winning card combination. The game history counters track the number of winning card combinations that were obtained during the game session. The game history counters are cleared for each new game session. The dynamic paytable method then proceeds to block 222.

At block 222, the dynamic paytable modification process is initiated. The paytable modification process is engaged after one or more triggering events. The threshold event is configured to use the game history counters to modify a subsequent prize associated with a subsequent triggering event. The paytable modification process may be based on a single variable such as the last winning twenty-one combination, or may be based on a multiplicity of other variables such as described in the commonly assigned patent application Ser. No. 10/273,440 entitled "Dynamic Paytable for Interactive Games" which is hereby incorporated by reference. After the dynamic paytable has been revised, the method proceeds to process block 224. For the static paytable, the method proceeds directly from process block 219 to process block 224.

At process block 224, the interactive twenty-one game discards the playing cards that make up the winning twenty-one card combination within the respective playing square. The playing square is then available to receive remaining playing cards in the deck.

At decision diamond 226, the player is provided with an opportunity to terminate the game session before the next card is dealt from the deck of playing cards. At decision diamond 224, the player determines whether to conclude the game by cashing out or to continue the playing the interactive twenty-one game. The determination of whether to conclude the game is based on inter alia the player's skill in analyzing the paytable, recalling the discarded playing cards, and by analyzing visible counters that monitor the interactive twenty-one game. If the player decides to cash-out and end the interactive twenty-one game, then the player is awarded the prize designated by the paytable and the game is concluded. If the player decision is to continue playing the interactive game, then the method returns to process block 210 in which the next top card in the deck of playing cards is displayed and the game proceeds as described above.

Returning to decision diamond 218, if the player is not awarded a prize at decision diamond 218 then the method proceeds to block 228. At block 228 the next card at the top of the deck is displayed. After displaying the next top card, the method then proceeds to decision diamond 230 where a game determination is made to terminate the games session. The game session may be terminated according to game rules for a variety of reasons. For the chargeable action embodiment, the game session may be terminated because of a lack of sufficient credits. Additionally, the game session is terminated if there are no playing squares available to receive any playing cards.

At decision diamond 232, the player has an opportunity to terminate the game by cashing out. The determination of whether to conclude the game is based on inter alia the player's skill in analyzing the paytable, recalling the discarded playing cards, and by analyzing visible counters that monitor the interactive twenty-one game. If the player decides to cash-out and end the interactive twenty-one game, then the player is awarded the prize according to the prior prizes awarded to the player. It shall be appreciated by those skilled in the art having the benefit of this disclosure that decision diamond 232 to cash out may occur before process block 230 without detracting from the basic principles of the invention.

Whether by way of decision diamond 226, decision diamond 230, or decision diamond 232 the method proceeds to repeat the processes described above. Each of the process blocks that are part of the repetitive process steps is referred to as a "game event". Additionally, a combination of process blocks that are part of the repetitive process steps may also referred to as a game event. The game session is therefore terminated when the player decides to cash-out, the player has no more available credits, there are no more cards in the deck, or the playing squares will receive no more playing cards.

Referring to FIG. 5 there is shown a flowchart for the paytable modification process in block 222. The paytable modification process determines whether the dynamic paytable is to be modified for the interactive twenty one game having five playing squares. As described in FIG. 4, the paytable modification process is initiated by the triggering event which a engages a number of game history counters. The paytable may be modified for a variety of reasons such as increasing the awards at the end of the game session to increase player excitement during the game session. Additionally, the paytable may be modified in a predictable manner so that the player may use knowledge of the paytable change to generate a reasoned player strategy.

In the illustrative paytable modification process 222, at decision diamond 240 the determination is made if the prize awarded to the player was the result of a player Blackjack. A Blackjack combination includes an Ace and another playing card having a count of 10. The Blackjack combination may be a mixed suit combination, a same color combination and a same suit combination. If the prize awarded to the player was based on a Blackjack combination, then in the illustrative embodiment the prize awarded for the next Blackjack combination is increased. As shown in block 242, the paytable increases the award for the next Blackjack combination. By increasing the payback to the player for the next Blackjack combination, the player adopts a strategy to maximize the number of Blackjack's received during a game session. If the prize awarded was not based on a Blackjack combination, then the method proceeds to decision diamond 244.

At decision diamond 244, the determination is made if the prize awarded to the player was based on the player having reached a total count of twenty-one. The twenty-one combination may be a mixed suit combination, a same color combination, and a same suit combination. If the prize awarded to the player is based on a twenty-one combination, then the process proceeds to block 246. At block 246, the prize awarded to the player is increased after one or more illustrative events occur. For example, the prizes awarded for each twenty-one combination may be dependent on the number of twenty-one combinations obtained. For example, after four (4) twenty-one combinations and eight (8) twenty-one combinations, the prizes awarded are increased. Additionally, the prizes awarded for each twenty-one combination may be increased after a predefined number of cards have been played. For example, after 16 cards are played the prizes awarded are increased, and after 33 cards the prizes awarded are increased further. If the prize awarded was not based on a twenty-one combination, then the method proceeds to process block 248.

At process block 248, the interactive game determines that all the cards in the illustrative deck of playing cards have been dealt. When all the cards have been dealt 20 to the player then the method proceeds to block 250 where the player receives "bonus" credits for having played all the cards in the deck. By way of example, the "bonus" credits may be an additional six (6) credits.

Referring to FIG. 6, there is shown an illustrative example of a paytable. The illustrative paytable 260 describes the prizes that are awarded to the player during the interactive twenty-one game. The first column shows the player the paytable for the player if the "NEXT" card combination within a playing square is either Blackjack or twenty-one. The blackjack combination is achieved with an Ace and a single card having a count of 10. The award for the Blackjack combination depends on the type of Blackjack combination. By way of example and not of limitation, for a Mixed Suit Blackjack combination, e.g. an Ace of diamonds and Jack of clubs, the player is awarded two credits. For the Same Color Blackjack combination, e.g. an Ace of diamonds and a Queen of hearts, the player is awarded four credits. Finally, for the Same Suit Blackjack combination, e.g. an Ace of diamonds and a King of diamonds, the player is awarded six credits.

The twenty-one combination is achieved by combining any of the cards within a playing square to achieve a total count of twenty-one. By way of example, a twenty-one combination would be a 3 of diamonds, an 8 of clubs, and a 10 of hearts. This twenty-one combination is a mixed suit combination which is entitled to a one (1) credit award. As shown in the paytable 260, the same color twenty-one combination provides a two (2) credit award, and the same suit twenty-one combination provides a three (3) credit award.

Illustrative Operation of Interactive Twenty-one Game

In the illustrative game session described below, a game session is initiated when the player inserts credits into an electronic game device configured to display the interactive twenty-one game and hits the "draw" button. The game session may also be initiated after a prior interactive twenty-one game has been played and the player decides to initiate a new game session with the player's available credits and hits the "draw" button. Alternatively, the game session may be initiated by the player without the use of credits by simply having the player hit the "draw" button.

A game session may be terminated when the player decides to end the game session, or when there are no available playing squares to receive another playing card from the deck or shoe, or when there are no more playing cards available in the deck or shoe. To better understand the interactive twenty-one game described here, the remaining drawings FIG.7 through FIG. 14 display portions of an illustrative game session.

Figure 7:
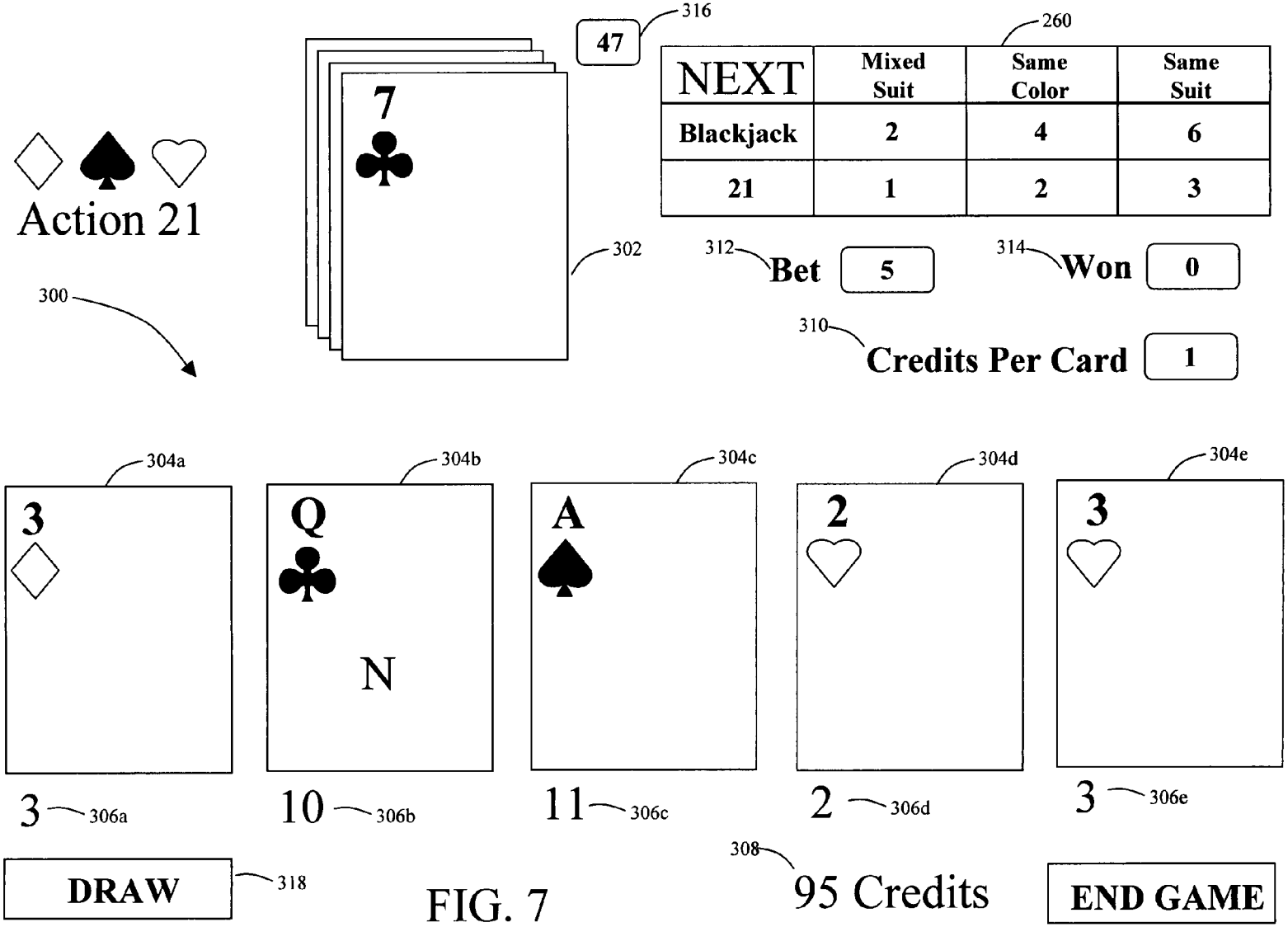
FIG. 7 is an illustrative example of the player interface after the twenty-one game has been activated.

Referring to FIG. 7 there is shown an illustrative example of the player interface after the twenty-one game has been initiated. In the illustrative embodiment, a game session is initiated when the player provides money or transferable credits as described above and hits the "draw" button. The illustrative player interface 300 is comprised of a deck of playing cards, a plurality of playing squares, a dynamic paytable, and a plurality of counters and meters. It shall be appreciated by those skilled in the art of gaming, that the deck of playing cards may also include a plurality of decks of playing cards or a "shoe" of playing cards.

In the illustrative embodiment, the deck of playing cards 302 is displayed at the top left portion of the screen. In the illustrative embodiment, the deck of playing cards is "electronically" shuffled to generate a deck of mixed playing cards. Below the deck 302 there is shown a plurality playing squares 304*a* through 304*e*. Each of the playing squares 304 is configured to receive at least one of the playing cards in deck 302. The dynamic paytable 260 is displayed at the top right hand corner of the player interface 300.

A plurality of counters and meters are provided to display game activity. For example, under each playing square 304*a* through 304*e* there are counters 306*a* through 306*e*, respectively, that count the total number of points within each of the playing squares. A credit meter 308 displays the credits that were received when money or credits were transferred to the game.

For the chargeable action embodiment, a credit per card meter 310 is provided to display the quantity of credits wagered by the player for each card that is transferred from the deck 302 to one of the playing squares 304. As previously described, the transfer of each card from the deck 320 is also referred to as a "chargeable action". The chargeable action occurs when the player is charged a predetermined number of credits for each playing card transferred from the deck 320 to one of the playing squares 304. The player may determine the credits wagered for each chargeable action by incrementing or decrementing the number of credits in the credits per card meter 310. Alternatively, the number of credits wagered in the credits per card meter 310 may be predetermined without any player input. In the average bet embodiment, there is not chargeable action and the player is charged only once at the beginning of the game session. However, for illustrative purposes the chargeable action embodiment is discussed in further detail below. It shall be appreciated by those of ordinary skill in the art that the chargeable action embodiment can be modified to the average bet embodiment.

Above the credit per card meter 310 is a bet meter 312 and an award meter 314. The bet meter 312 monitors the total number of credits that are bet or wagered during the game session. The award meter 314 monitors the total number of credits that are won during the game session. The award meter 314 is configured to be incremented each time a prize is awarded to the player. A deck meter 316 monitors the remaining number of cards in the deck 302.

Finally, a "draw" button 318 at the bottom left of the display screen is used to initiate a game session. As previously noted, the game session may be conducted in conjunction with the receipt or transfer of credits.

The illustrative player interface 300 operates on the illustrative touch screen display 112 of FIG. 1. In the illustrative embodiment the interactive twenty-one game is displayed one game session at a time. Alternatively, a plurality of interactive twenty-one game sessions may be displayed on a single monitor or screen.

For illustrative purposes the game session displayed in FIG. 7 is initiated with the player having 100 credits and the player being charged one credit for each card dealt from the deck 302. Although not shown, the 100 credits are displayed in the credit meter 308. The player then hits the draw button 318. After hitting the draw button 318, then five cards are dealt from the deck 302. Each card that is dealt is placed in one of the playing squares 304*a* through 304*e* such that playing square 304*a* receives a Three of Diamonds, playing square 304*b* receives a Queen of Clubs, playing square 304*c* receives an Ace of Spades, playing square 304*d* receives a Two of Hearts, and playing square 304*e* receives a Three of Hearts. The deck meter 316 is decremented to "47" because of the five cards dealt from deck 302. Each of the counters 306*a* through 306*e* is revised to display the total count for each playing square. Finally, the bet meter 312 is incremented to show that "5" credits have been wagered for each chargeable action of transferring a card from the deck 302 to one of the playing squares 304.

The top card in the deck 320 is a Seven of Clubs. If the player decides to continue the game, the player must decide in which of the five playing squares to place the Seven of Clubs. For illustrative purposes the player is a skilled player that selects playing square 304*b* to receive the Seven of Clubs. The player is a skilled player because the player is attempting to achieve a same suit "21" combination within playing square 304*b*. The selection of playing square 304*b* is identified by the hand icon 320 that is over the Queen of Clubs. The selection of the playing square may also be performed by touching the player interface or touching a button (not shown) under each playing square.

Figure 8:
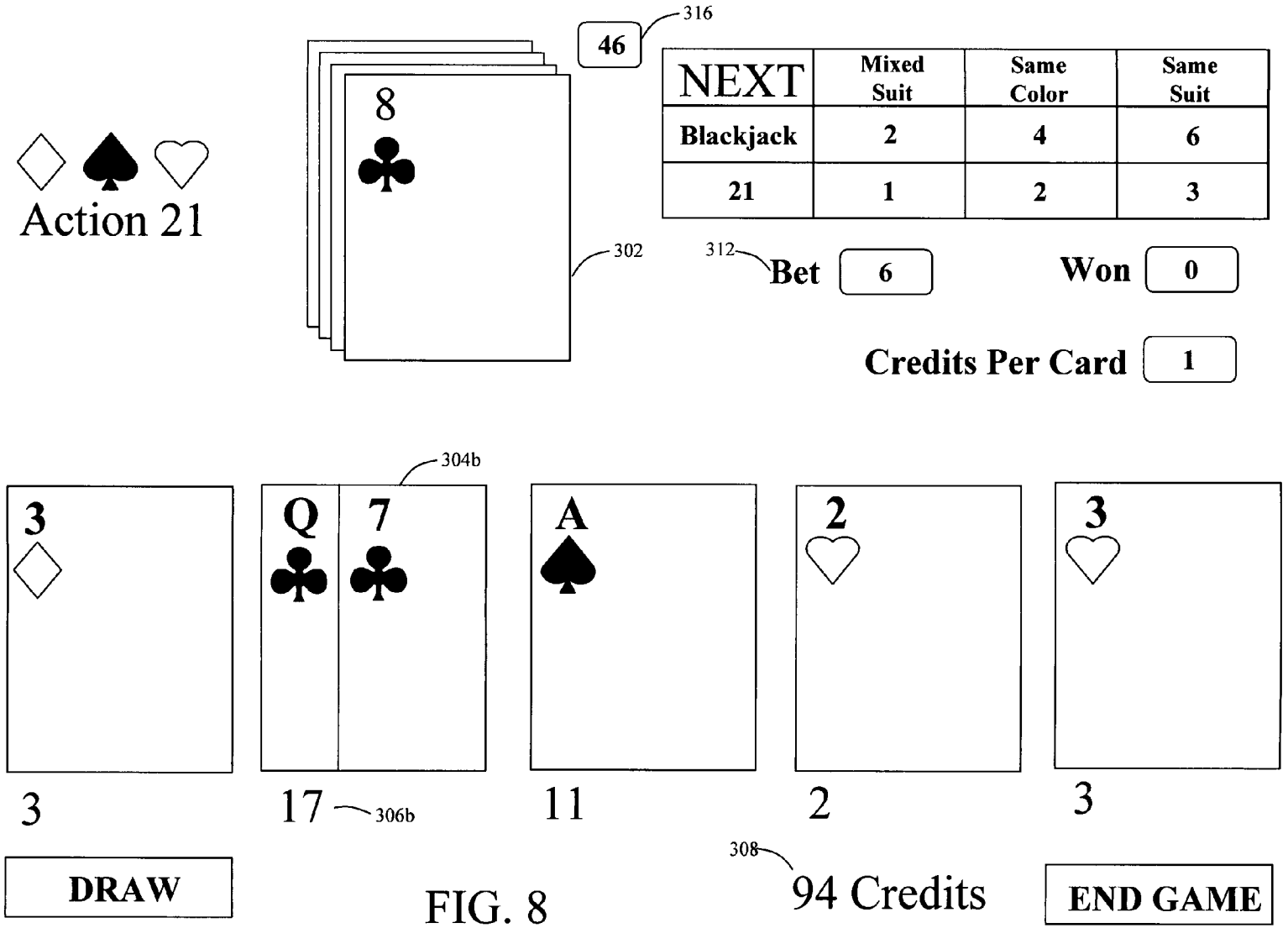
FIG. 8 is an illustrative example of the player interface after the sixth card has been dealt in the twenty-one game.

Referring to FIG. 8, there is shown an illustrative example of the player interface after the sixth card, i.e. Seven of Clubs, is dealt to playing square 304*b* having the Queen of Clubs. The associated counter 306*b* is incremented to reflect a total count of "17" for playing square 306*b*. Additionally, the number of available player credits in credit meter 308 is decremented to "94". Meanwhile, the bet meter 312 is incremented to "6" since six cards have been transferred from deck 302, and correspondingly the card meter 316 is decremented to "46". Finally, the deck 302 is modified to display a new top card of eight of clubs.

Figure 9:
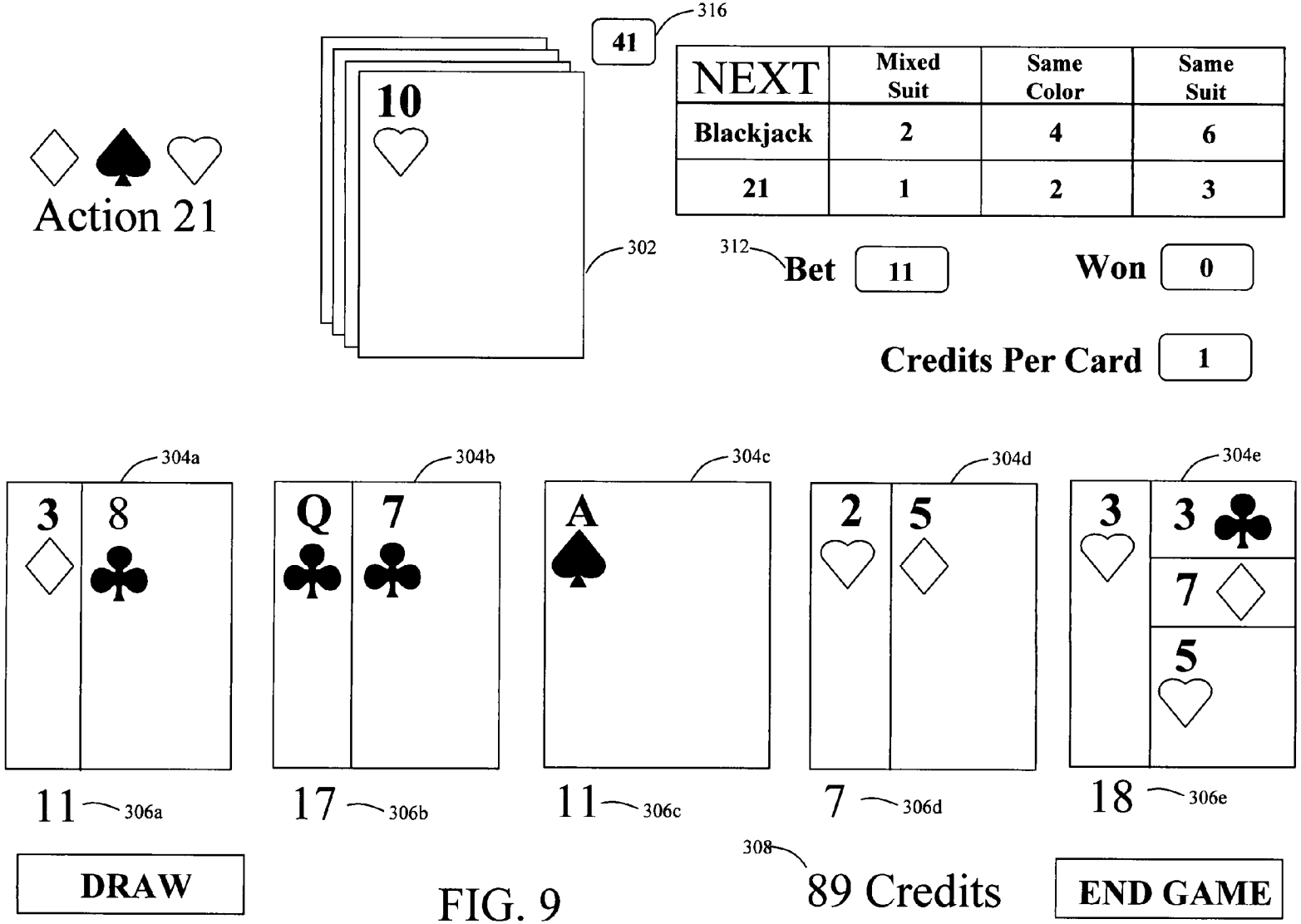
FIG. 9 is an illustrative example of the player interface after eleven cards have been dealt in the twenty-one game.

In FIG. 8, the player must now decide what to do with the Eight of Clubs. The player has the option of placing the card within any playing square except for playing square 304*b*. The player can not place the Eight of Clubs in the playing square 304*b* because the total count would be "25" and this count exceeds the twenty-one count maximum permitted for each playing square. A skilled player would also not place the eight of clubs on top of the Ace of spades because this would reduce the player's potential payback in half because the potential Blackjack payout is reduced to a potential twenty-one prize payout. Additionally, the skilled player would not place the Eight of Clubs on the Two of Hearts because the option of placing the Eight of Clubs on the Three of Hearts or the Three of Diamonds is a better choice. The option of placing the Eight of Clubs on the Three of Diamonds or the Three of Hearts is a better choice because the total count in each of these playing squares is "11". With an "11" count there is a substantially greater likelihood of reaching a "21" count with a card having a value of "10". Note that there are 16 cards in a deck having a count of "10". Thus, a skilled player would place the Eight of Clubs on either the Three of Diamonds or the Three of Clubs. As shown in FIG. 9, the player decides to place the Eight of Clubs on the Three of Diamonds.

Referring to FIG. 9 there is shown an illustrative example of the player interface after eleven cards have been dealt in the interactive twenty-one game. As mentioned previously, the seventh card dealt was an Eight of Clubs and this card was placed in the playing square 304*a* to achieve the total count of "11". Four additional cards were also dealt, namely, a Five of Diamonds, a Three of Clubs, a Seven of Diamonds and a Five of Hearts. The Five of Diamonds was placed in playing square 304*d*. The Three of Clubs, Seven of Diamonds and Five of Hearts were each placed in playing square 304*e*. The top card in the deck 302 is a Ten of Hearts.

Counter 306*a* indicates that the count for playing square 304*a* remains 11. Counter 306*b* indicates that the count for playing square 304*b* remains 17. Counter 306*c* indicates that the count for playing square 304*c* remains 11. Counter 306*d* indicates that the count for playing square 304*d* is 7. Counter 306*e* indicates that the count for playing square 304*e* is 18. Deck meter 316 indicates that there are 41 cards remaining in the deck. Bet meter 312 shows that 11 credits have been charged. Credit meter 308 shows that there are 89 available credits.

The player must now decide in which playing square to place the Ten of Hearts. The player has two options to be awarded a prize, namely, to place the Ten of Hearts in playing square 304*a* for a "21" prize of one credit, or to place the Ten of Hearts in playing square 304*c* for a "Blackjack" prize of two credits.

Figure 10:
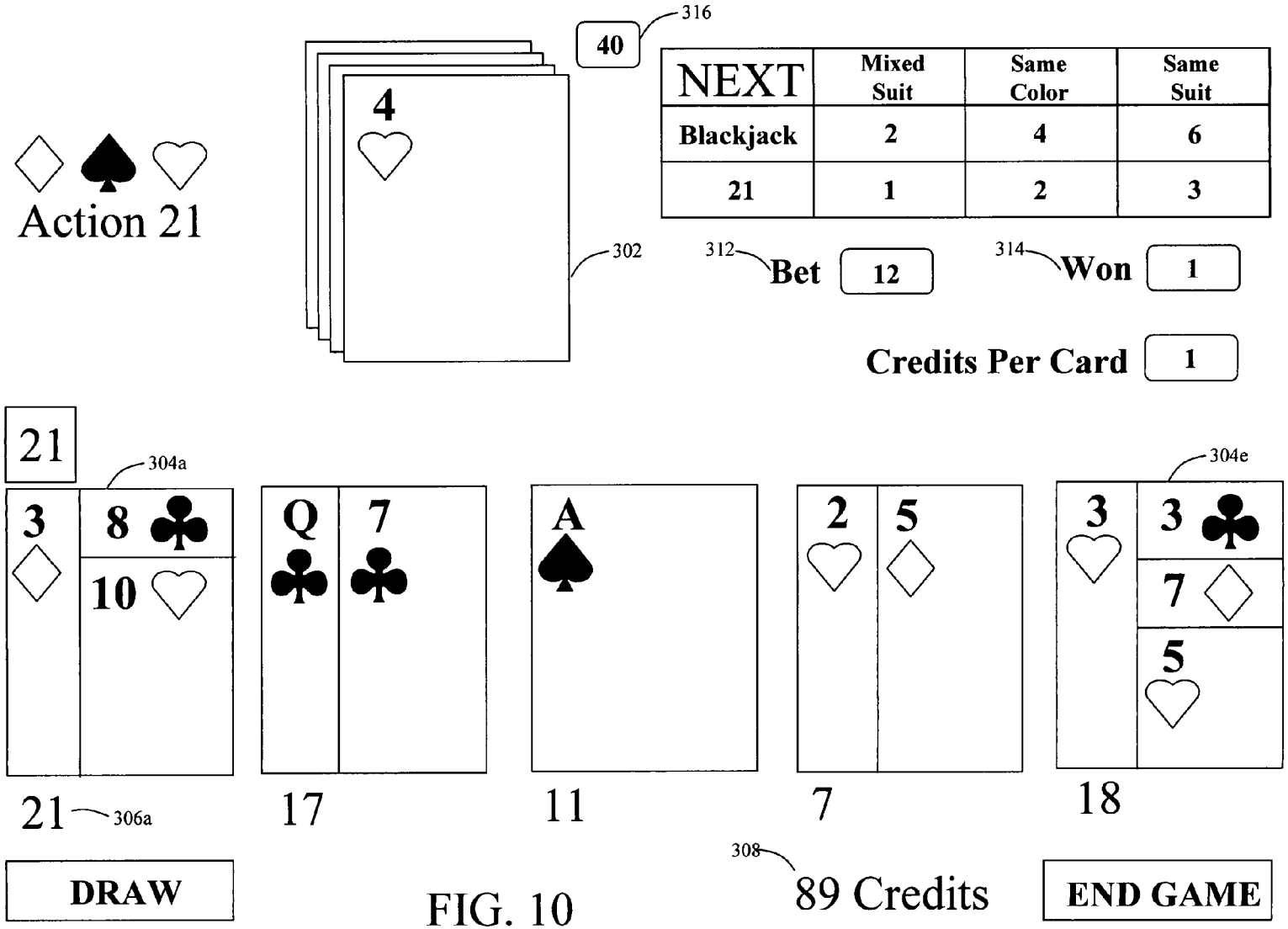
FIG. 10 is an illustrative example of the player interface after the player's first twenty-one award.

As shown by FIG. 10, the player decides to place the Ten of Hearts in playing square 304*a* and receives an award of one credit. The cards in the playing square 304*a* are then removed (not shown). The decision to place the Ten of Hearts in playing square 304*a* was because of the mixed suit card combination within playing square 304*a*. The player was attempting to preserve the Ace of Spades for another card that would provide a same color prize or same suit prize as shown in the paytable 260.

After placing the Ten of Hearts in playing square 304*a*, the counter 306*a* displays the total count of "21". A "21" symbol is then displayed over the playing square 304*a* to show that the player obtained a twenty-one combination. The deck meter 316 is decremented by one to display there are "40" remaining cards. The bet meter 312 displays "12" credits having been wagered. The award meter 314 is updated to show the player award of "1" credit for having received a twenty-one prize combination.

The credit meter 308 displays that there are "89" available credits for the player to wager. The number of available credits has not changed because the credit meter has accounted for the one credit prize awarded to the player. Hence, the credit meter 308 operates according to the following equation:

$$AC=CABGS-CB+CW$$

where;

AC represents the available credits displayed in the credit meter 308;

CABGS represents the credits available at the beginning of the game session;

CB represents the wagered credits identified by the bet meter; and

CW represents the credits won.

Thus, when the player is awarded an intermediary prize during the game session, the intermediary prize may be transferred to the credit meter 308 so that the player may apply the newly awarded credits towards continuing the game session. The awarding of an intermediary prize adds a heightened level of player interactivity because the player may decide to end the game session after the intermediary prize is awarded.

The deck 302 reveals that the next card is a Four of Hearts. If the player wants to continue the game, the player must decide where the Four of Hearts should be placed. The player may place the Four of Hearts in any of playing squares except for playing square 304*e* because the total count in playing square 304*e* can not exceed twenty-one. Notice that if the player places the Four of Hearts on playing square 304*b*, then the player could be awarded a prize for having a twenty-one combination. However, the twenty-one combination is a mixed suit combination having a prize of only one credit.

Figure 11:
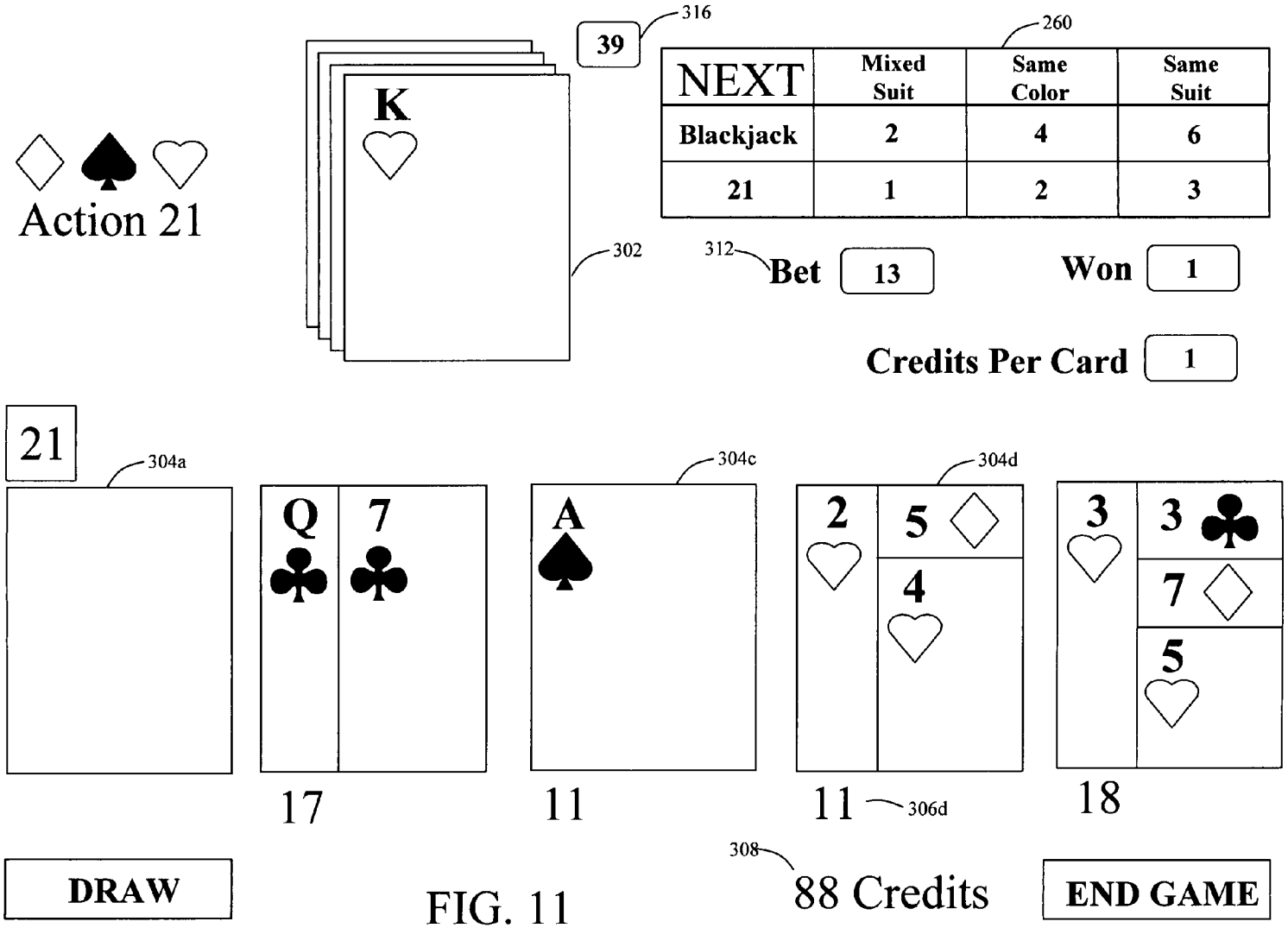
FIG. 11 is an illustrative example of the player interface after thirteen cards have been dealt in the twenty-one game.

Referring to FIG. 11, the player has elected to place the Four of Hearts in playing square 304d. The counter 306*d* shows a total of "11" points in playing square 304*d*. Notice that all the cards in playing square 304*d* are all the same color, thus the player has preserved a potential twenty-one prize for a same color combination. After transferring the Four of Hearts from the deck 302, the deck meter 316 is decremented by one card to show "9" remaining cards. The bet meter 312 is incremented to "13" and the credit meter 308 is decremented to "88". Additionally, the playing square 304*a* is shown to be empty as a result of the prior twenty-one combination.

The top card displayed in deck 302 is a King of Hearts. The player must then decide where to place the King of Hearts. The player has a limited number of locations to place the King of Hearts, namely, playing squares 304*a*, 304*c*, or 304*d*. The player may not place the King of Hearts in playing squares 304*b* and 304*d* because the total count would exceed twenty-one.

Figure 12:
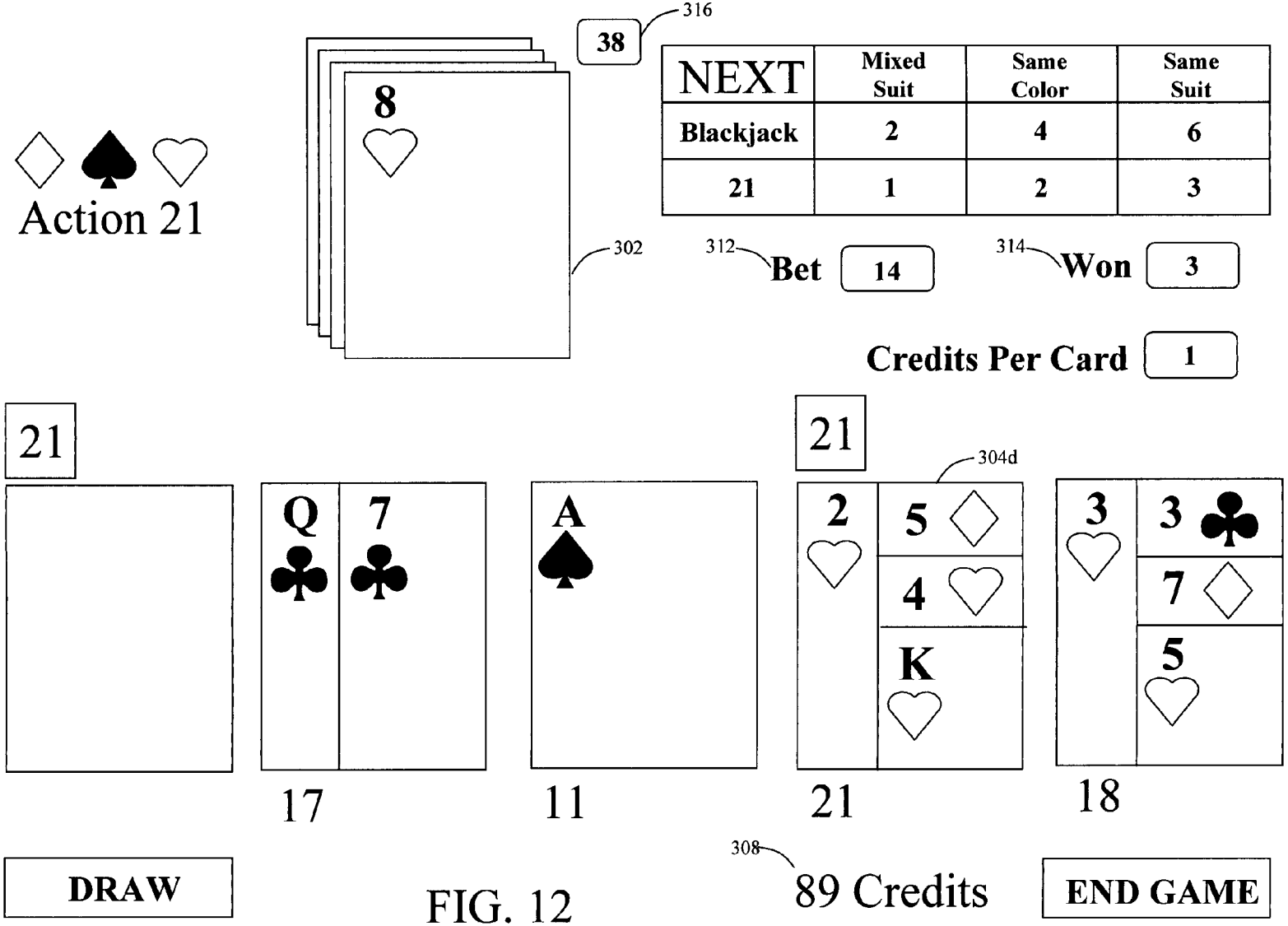
FIG. 12 is an illustrative example of the player interface after the player's second twenty-one award.

Referring to FIG. 12, the player decides to place the King of Hearts in playing square 304*d*. As a result the player receives a prize of "2" credits for having a same color twenty-one combination. A "21" symbol is then displayed over the playing square 304*d* to show that the player obtained a twenty-one combination. Additionally, the award meter 314 is incremented two credits to display "3" won credits. Also, the bet meter 312 is incremented by one credit to display "14" wagered credits. In this instance, the credit meter 308 is incremented to "89" to reflect the intermediary prize award of two credits.

The top card displayed in deck 302 is an Eight of Hearts. The player must again decide where to place the Eight of Hearts. Notice that the playing square 304*d* is cleared (not shown) so that the Eight of Hearts may be received in this playing square. Additionally, playing squares 304*a* which is empty and playing square 304*c* may also receive the Eight of Hearts. The playing squares 304*b* and 304*e* may not receive the Eight of Hearts.

Figure 13:
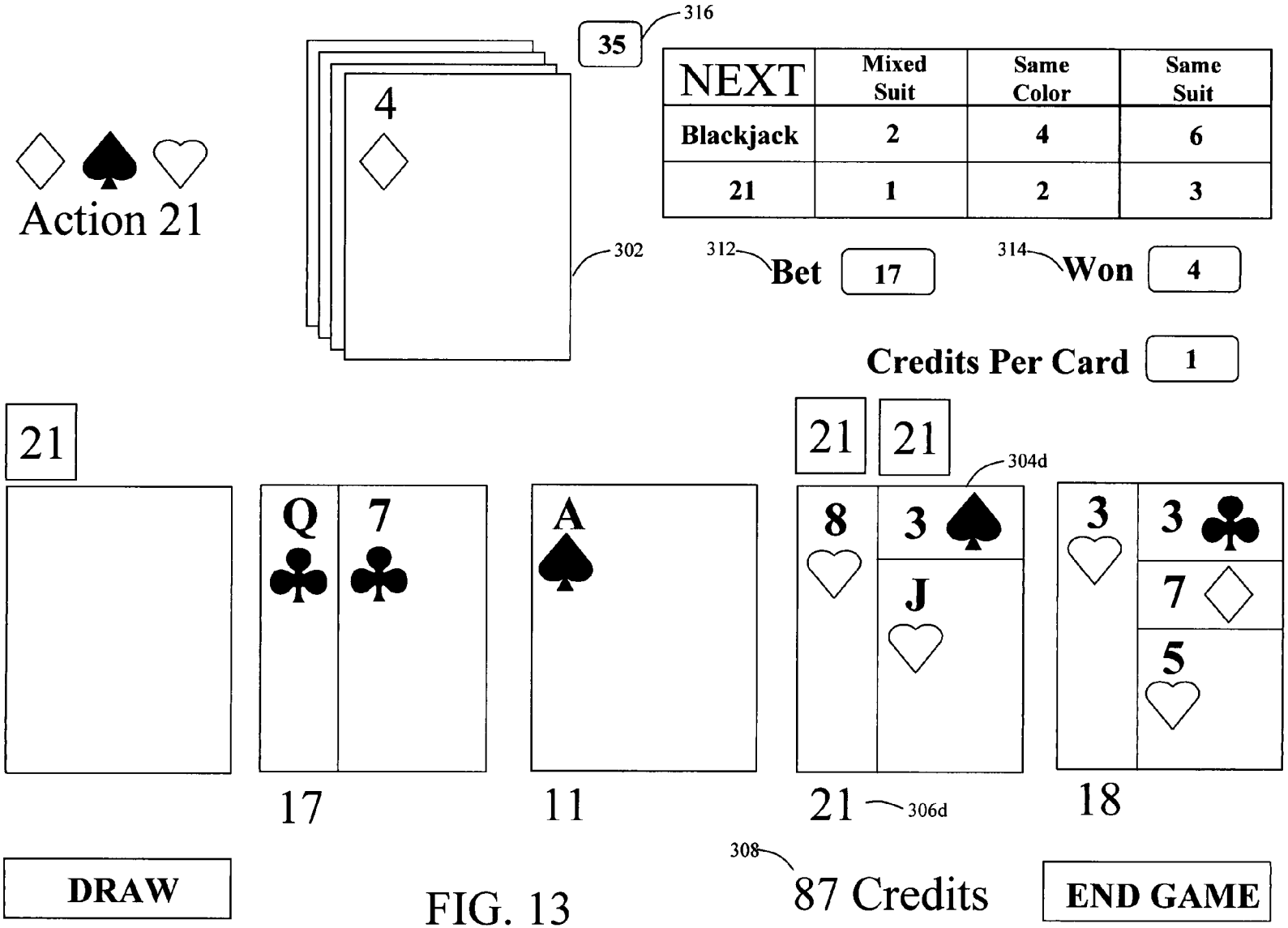
FIG. 13 is an illustrative example of the player interface after the player's third twenty-one award.

Referring to FIG. 13, the player decides to place the Eight of Hearts in playing square 304*d*. Additionally, the player has decided to place the next two cards, namely, the Three of Spades and the Jack of Hearts in playing square 304*d*. The result is that playing square 304*d* has a total count of twenty-one as indicated by counter 3 06*d* and the additional "21" symbol over playing square 304*d*. The twenty-one combination in playing square 304*d* is a mixed suit combination that entitles the player to a one prize credit. The award meter 314 is incremented one credit to reflect that the player has won "4" credits during the game session. The bet meter 312 shows that the player has wagered "17" credits. The credit meter 308 displays that there are "87" credits available. The deck meter 316 indicates that there are "35" cards left in the deck.

The top card in the deck is a Four of Diamonds. If the player decides to continue the game session, then the player must decide in which playing square to place the Four of Diamonds.

Figure 14:
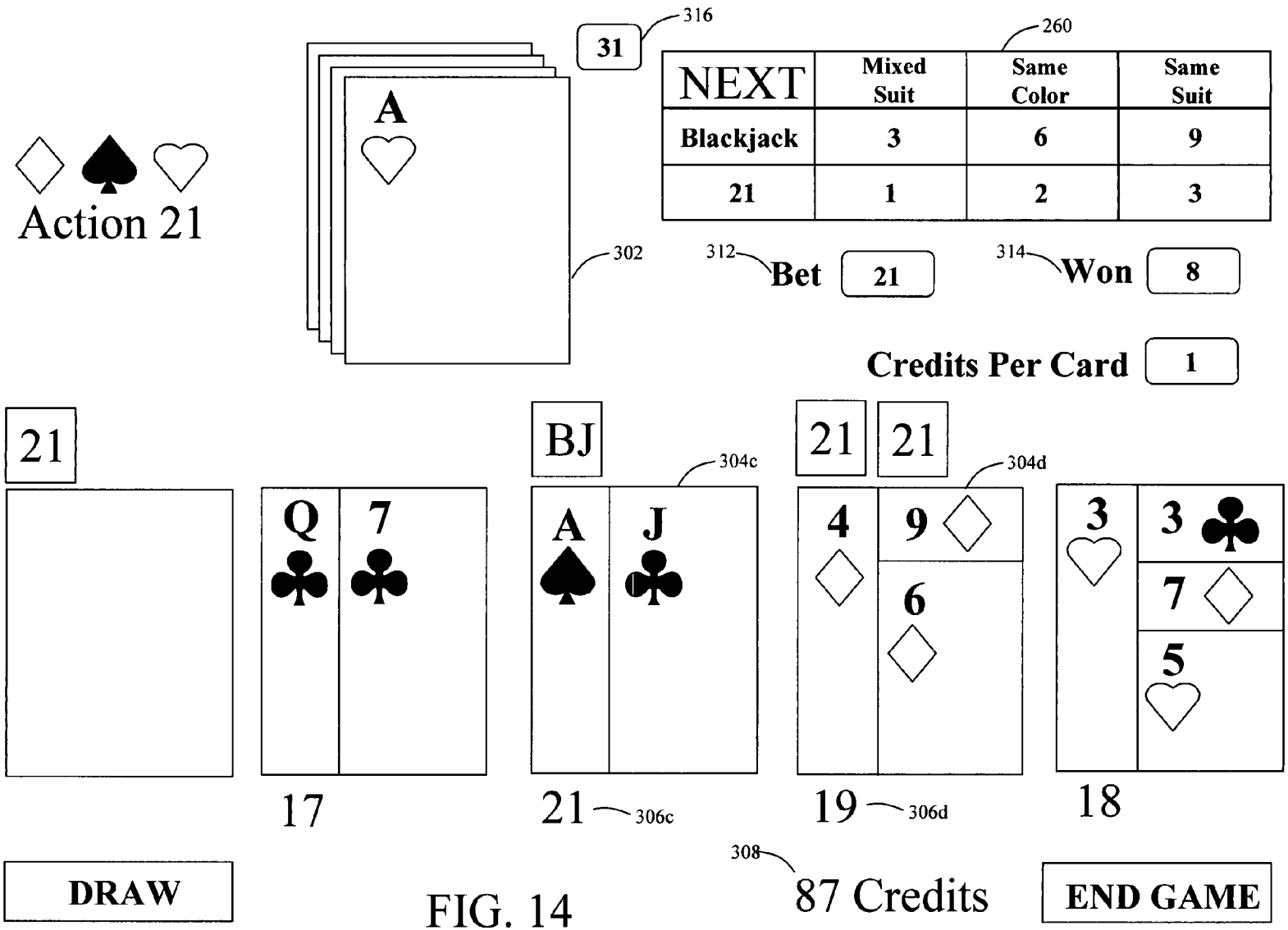
FIG. 14 is an illustrative example of the player interface after the player receives his first Blackjack award.

Referring to FIG. 14 there is shown that the player decided to place the Four of Diamonds in playing square 304*d*. The subsequent cards that were dealt, namely, the Nine of Diamonds and the Six of Diamonds were also placed in playing square 304*d*.

The next card dealt was a Jack of Clubs that was placed in playing square 304*c* resulting in a same color Blackjack combination. As a result of placing the Jack of Clubs in playing square 304*c*, the player is awarded a same color Blackjack combination prize of "4" credits. The award meter 314 is incremented by four credits to display "8" won credits. The bet meter is decremented to display "21" bet credits and the credit meter 308 displays "87" available credits.

Notice that the paytable 260 has been revised. The paytable has been revised because a triggering event resulted in changing the paytable. The triggering event in this illustrative example was the player having achieved a Blackjack combination that activates a Blackjack game history counter. The Blackjack game history counter is incremented accordingly. The threshold event then uses the Blackjack game history counter to modify a subsequent prize associated with a subsequent triggering event. Thus, the threshold event results in increasing the Blackjack prizes awarded to the player. More particularly, the mixed suit prize has increased to "3" credits, the same color prize has increased to "6" credits and the same suit prize has increased to "9" credits. The top card that is displayed is an Ace of Diamonds and the player must decide where to place this card if the player decides to continue playing the game. Generally, the decision to place a dealt card in one of the playing squares is accomplished with a degree of knowledge based skill.

For purposes of this patent, "player skill" includes three components: minimal skill, dexterity skill, and knowledge skill. Generally, all games include these components, however, the degree of skill varies for each game. As described above, minimal skill refers to the player having a minimal understanding of the rules of the game and minimal dexterity needed to apply the rules of the game. To play a game according to the game rules, the player must possess minimal skill. Dexterity skill is based on the player's reflexes or coordination. Most games require a degree of dexterity to establish game play. Certain games such as arcade video games or pinball machines are primarily dexterity based skill games. Knowledge skill is based on the player's experience and analytical abilities.

The present invention provides the player with a variety of opportunities to evaluate a variety of different decisions. By making knowledgeable decisions, the player preserves the amount of available credits and can enjoy playing the interactive twenty-one game for a long period of time. Additionally, it is possible for that knowledgeable decisions may increase the likelihood of winning a total prize that exceeds the amount wagered. In making knowledge based skill decisions, the player's evaluation includes evaluating the history of cards dealt, the paytable, the cards in the playing squares and the likelihood of the future cards dealt. Therefore, these decision making opportunities provide the player with an opportunity to preserve winnings and minimize losses. By preserving winnings and minimizing losses, the player can enjoy playing the interactive twenty-one game for a much longer period of time. If the player did not possess knowledge based skill to preserve winnings and minimize losses, the player would quickly spend his available credits.

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the illustrative examples given.

What is claimed is:

1. A method for playing a twenty-one game using a deck of playing cards, comprising:

initiating a game session;

providing a plurality of playing squares configured to receive a plurality of playing cards from said deck;

providing each dealt playing card with a value where,

Kings, Queens and Jacks count as 10 points,

Aces count as either 1 or 11 points, and all other cards have a point value that corresponds to their face value;

performing a plurality of game events wherein each game event comprises drawing one or more playing cards from said deck and transferring each of said playing cards to one of said plurality of playing squares;

performing a plurality of chargeable actions wherein each chargeable action comprises charging said player at least one credit for drawing said one or more playing cards from said deck and transferring said one or more playing cards to said plurality of playing squares; and awarding said player one or more prizes according to a dynamic paytable that is modified during said game session.

2. The method of claim 1 wherein said initiating of said game session is initiated by receiving one or more credits.

3. The method of claim 1 further comprising displaying a top card from said deck of playing cards and awaiting a player instruction to transfer said top card to one of said plurality of playing squares.

4. The method of claim 3, wherein prior to receiving said player instruction, said player has an opportunity to evaluate a plurality of different actions.

5. The method of claim 1 further comprising permitting said player to terminate said game session after each game event.

6. The method of claim 1, wherein said dynamic paytable further comprises a triggering event that is configured to start at least one game history counter for each of said plurality of playing squares, said triggering event is associated with a total count of 21 points, and a threshold event that is engaged after one or more triggering events, said threshold event configured to use said game history counter to modify a subsequent prize associated with a subsequent triggering event.

7. The method of claim 6 wherein one of said triggering events comprises a blackjack combination, said blackjack combination including an Ace and a single playing card having a count of 10.

8. The method of claim 7 wherein said threshold event awards a same suit blackjack combination a better prize than a same color blackjack combination.

9. The method of claim 7 wherein said threshold event awards a same color blackjack combination a better prize than a mixed suit blackjack combination.

10. The method of claim 6 wherein said triggering events also comprises a 21 count combination that comprises more than two cards.

11. The method of claim 10 wherein said threshold event awards a same suit 21 combination a better prize than a same color 21 combination.

12. The method of claim 10 wherein said threshold event awards a same color 21 combination a better prize than a mixed suit 21 combination.

13. The method of claim 6 wherein said player is awarded a bonus prize after said player has used all 52 cards.

14. The method of claim 6 further comprising removing a plurality of cards within one of said playing squares after said player is awarded a prize.

15. The method of claim 1 further comprising networking a plurality of said interactive games.

16. A twenty-one gaming system comprising:

a player interface configured to display, at least one deck of playing cards in which Kings, Queens and Jacks count as 10 points, Aces count as either 1 or 11 points, and all other cards have a point value that corresponds to their face value, and a plurality of playing squares which are configured to receive at least one of said playing cards;

a credit meter configured to identify each chargeable action in which at least one credit is charged to a player each time one of said playing cards is transferred from said deck to one of said plurality of playing squares;

a processor in operative communication with said player interface and said credit meter, said processor configured to determine when to award said player a prize; and a memory communicatively coupled to said processor, said memory configured to store a dynamic paytable that identifies prizes awarded for having said player reach a total count of 21 for one or more of said playing squares, said dynamic paytable being modified during said game session.

17. The gaming system of claim 16 further comprising a monetary input component communicatively coupled to said processor, said monetary input component configured to convert money to said at least one credit.

18. The gaming system of claim 16 further comprising a termination button configured to permit said player to terminate said game session after one of said plurality of cards is dealt.

19. The gaming system of claim 16 further comprising a network interface card communicatively coupled to said processor, said network interface card configured to permit said electronic gaming system to communicate with another networked device.

20. A method for playing a twenty-one game using a deck of playing cards, comprising:

initiating a game session;

providing a plurality of playing squares configured to receive a plurality of playing cards from said deck;

providing each dealt playing card with a value where,

Kings, Queens and Jacks count as 10 points,

Aces count as either 1 or 11 points, and all other cards have a point value that corresponds to their face value;

performing a plurality of game events wherein each game event comprises drawing one or more playing cards from said deck and transferring each of said playing cards to one of said plurality of playing squares; and awarding said player one or more prizes according to a dynamic paytable that is modified during said game session and wherein said dynamic paytable further comprises, a triggering event that is configured to start at least one game history counter for each of said plurality of playing squares, said triggering event is associated with a total count of 21 points, and a threshold event that is engaged after one or more triggering events, said threshold event configured to use said game history counter to modify a subsequent prize associated with a subsequent triggering event.

21. The method of claim 20 wherein said initiating of said game session is initiated by receiving one or more credits.

22. The method of claim 20 further comprising displaying a top card from said deck of playing cards and awaiting a player instruction to transfer said top card to one of said plurality of playing squares.

23. The method of claim 22, wherein prior to receiving said player instruction, said player has an opportunity to evaluate a plurality of different actions.

24. The method of claim 20 further comprising permitting said player to terminate said game session after each game event.

25. The method of claim 20 wherein one of said triggering events comprises a blackjack combination, said blackjack combination including an Ace and a single playing card having a count of 10.

26. The method of claim 25 wherein said threshold event awards a same suit blackjack combination a better prize than a same color blackjack combination.

27. The method of claim 25 wherein said threshold event awards a same color blackjack combination a better prize than a mixed suit blackjack combination.

28. The method of claim 20 wherein said triggering events also comprise a 21 count combination that comprises more than two cards.

29. The method of claim 28 wherein said threshold event awards a same suit 21 combination a better prize than a same color 21 combination.

30. The method of claim 28 wherein said threshold event awards a same color 21 combination a better prize than a mixed suit 21 combination.

31. The method of claim 20 wherein said player is awarded a bonus prize after said player has used all 52 cards.

32. The method of claim 20 further comprising removing a plurality of cards within one of said playing squares after said player is awarded a prize.

33. The method of claim 20 further comprising networking a plurality of said interactive games.

34. An interactive twenty-one gaming system comprising:

a player interface configured to display, at least one deck of playing cards in which Kings, Queens and Jacks count as 10 points, Aces count as either 1 or 11 points, and all other cards have a point value that corresponds to their face value, and a plurality of playing squares which are configured to receive at least one of said playing cards;

a processor in operative communication with said player interface, said processor configured to determine when to award said player a prize; and a memory communicatively coupled to said processor, said memory configured to store a dynamic paytable, said dynamic paytable, said dynamic Davtable being modified during said game session and further comprising, a triggering event that is configured to start at least one game history counter for each of said plurality of playing squares, said triggering event is associated with a total count of 21 points, and a threshold event that is engaged after one or more triggering events, said threshold event configured to use said game history counter to modify a subsequent prize associated with a subsequent triggering event.

35. The gaming system of claim 34 further comprising a monetary input component communicatively coupled to said processor, said monetary input component configured to convert money to said at least one credit.

36. The gaming system of claim 34 further comprising a termination button configured to permit said player to terminate said game session after one of said plurality of cards is dealt.

37. The gaming system of claim 34 further comprising a network interface card communicatively coupled to said processor, said network interface card configured to permit said electronic gaming system to communicate with another networked device.

* * * * *